United States Patent [19]

Paulson

[11] Patent Number: 4,778,210

[45] Date of Patent: Oct. 18, 1988

[54] EMPTY CAN CARRIER

[76] Inventor: J. Rene Paulson, P.O. Box 334, Lachute, Quebec, Canada, J8H 3X5

[21] Appl. No.: 100,263

[22] Filed: Sep. 23, 1987

[30] Foreign Application Priority Data

Oct. 24, 1986 [CA] Canada ..... 521388

[51] Int. Cl.[4] ..... B65D 71/00

[52] U.S. Cl. ..... 294/87.2; 206/159; 206/427; 206/493; 294/158; 294/159

[58] Field of Search ..... 294/27.1, 33, 87.1, 294/87.2, 87.28, 137, 145, 148, 158, 159, 165, 166, 170; 16/114 R; 206/139, 142, 143, 145, 147–149, 151, 159, 162, 170, 175, 201, 427, 493; 211/71–74; 220/85 H, 94 R

[56] References Cited

U.S. PATENT DOCUMENTS

| | | | |
|---|---|---|---|
| 2,514,858 | 7/1950 | Gray | 294/87.2 |
| 2,646,911 | 7/1953 | Holmberg | 294/87.2 X |
| 2,711,873 | 6/1955 | Larin | 211/73 X |
| 2,902,310 | 9/1959 | Berce | 294/33 |
| 3,016,136 | 1/1962 | Poupitch | 16/114 R X |
| 3,726,558 | 4/1973 | Klygis | 294/87.2 |
| 3,867,738 | 2/1975 | Garner | 294/27.1 |
| 4,111,298 | 9/1978 | Mascia et al. | 294/87.2 X |
| 4,236,638 | 12/1980 | Griffith | 294/87.2 X |

FOREIGN PATENT DOCUMENTS

| | | | |
|---|---|---|---|
| 688954 | 3/1953 | United Kingdom | 294/87.28 |

*Primary Examiner*—Johnny D. Cherry

*Attorney, Agent, or Firm*—Jones, Tullar & Cooper

[57] ABSTRACT

The invention relates to a carrier for empty beverage cans, particularly those that are returnable and recyclable. The carrier includes an elongated support member and a plurality of spaced apart hook members extending laterally therefrom, each hook member being adapted to enter the pour opening of an empty can and to engage the underside of the top plate of the can to suspend the can therefrom. By using the carrier, people returning cans have a convenient way of carrying the cans and the people receiving the cans are able to easily count the cans. The support members could also be used to carry suitable advertising if desired.

1 Claim, 5 Drawing Sheets

EMPTY CAN CARRIER

The present invention relates to a device for carrying empty cans, such as empty pop and/or beer cans, especially such cans that are returnable to a store for a refund.

BACKGROUND OF THE INVENTION

The beverage industry has over the past ten or fifteen years increased drastically its use of thin-walled aluminum cans, particularly for soft drinks and beer. The use of such cans has prompted a hue and cry from environmentalists who have objected to the disposal of empty cans in the trash. As a consequence many states and provinces encourage the recycling of aluminum cans and promote such recycling by instituting a deposit/-refund program under which the purchaser pays a deposit of, say, five cents per can at the time of purchase and is entitled to a refund of the same amount when he returns the empty can. This program can create many headaches and problems at the locations where the cans are returned since, very often, they are returned by the bag-full and they must be counted and possibly sorted, a time consuming and thankless job.

There have been many inventions relating to carriers for cans; however such inventions have all been directed to the packaging or carrying of full cans. No one has directed their energies to the problems associated with returnable "empties", especially in the beer or soft drink field.

SUMMARY OF THE INVENTION

The present invention addresses the problem of returnable "empties" by providing a carrier which is light in weight, is easy and inexpensive to manufacture, is adaptable for advertising purposes, and can be recyclable along with the cans carried thereby. Broadly speaking the carrier of this invention utilizes a support member and a plurality of hook means carried by the support member with each hook means being adapted to extend through the pour opening of an empty can and to engage the top plate of the can, thereby to support the can adjacent the support member.

Typically the support member could be a thin, narrow strip of plastic or aluminum having a length approximately equal to the total of the diameters of the number of cans to be carried on each side. An appropriate number of hooks, say five, would be provided on each side of the strip and each hook would be engageable with the pour opening of a can, so that when the carrier was full there would be ten cans carried thereby. When the full carrier is brought to the can redemption center it is easily handled by all parties concerned; the can tops are readily viewable so that the receiver can quickly determine whether the cans are of the redeemable variety; and the refund calculation can be made almost automatically. By using the carrier of the present invention the task performed by all parties involved is made easier and since the inconvenience of returning cans would be diminished it is likely that more people would be inclined to return their cans rather than to relegate them to the trash.

There are many forms that the hook means of the invention could take, depending for example on whether the carrier is to be recyclable along with the cans themselves or whether it is to be reused, perhaps with advertising thereon.

The present invention will be described in greater detail hereinafter and with reference to the drawings attached hereto.

DESCRIPTION OF THE PREFERRED EMBODIMENT

Figure 1:
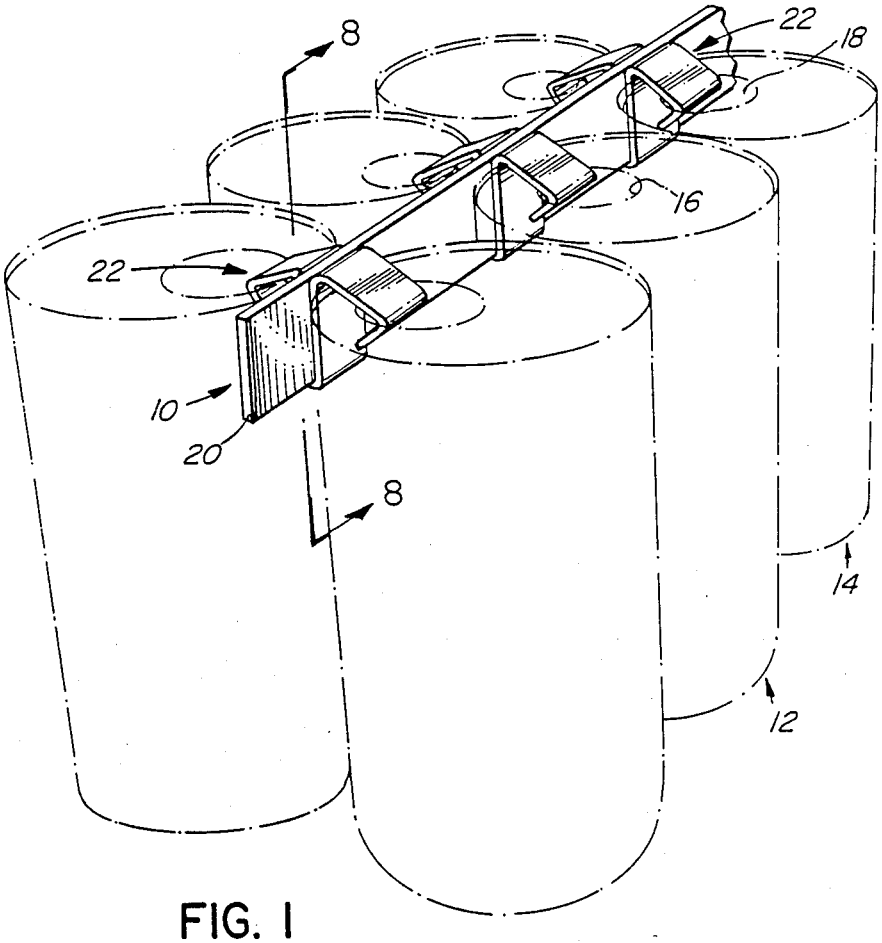
FIG. 1 illustrates in perspective view a first embodiment of the can carrier of this invention.

FIG. 1 of the drawings illustrates the can carrier 10 of this invention in association with several empty beverage cans 12,14. The cans may represent different brands of beverage and may be of different constructions but they all share a single feature, namely a pour opening through which the beverage is removable from the can. The pour opening may be circular, like the opening 16 in can 12, or it may be slightly elliptical, like the opening 18 in can 14. In any event, once the can has been opened and the beverage removed, the pour opening 16,18 provides a permanent access to the interior of the can. Typically the pour opening will have a maximum width of from 1.5 to 2 cm.

The present invention makes use of the pour opening of an empty can by providing means for engaging the can via the pour opening to hold the can in place. With further reference to FIG. 1 the can carrier 10 of this invention includes an elongated support member 20 and a plurality of hook means 22 spaced apart along the support member for engaging the pour openings of the cans.

Figure 2:
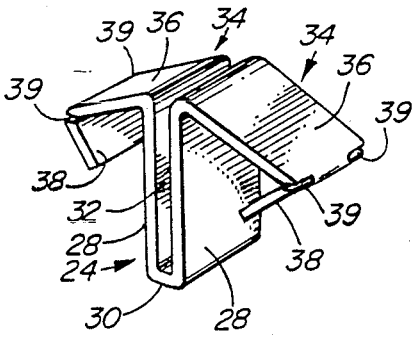
FIG. 2 illustrates in enlarged perspective a first clip and hook arrangement for use with the first embodiment.

Since it is easy to count in multiples of ten the support member 20 could have a length such that five cans could be carried on each side thereof, necessitating five hook means 22 of each side. In the embodiment according to FIGS. 1–3 the support member 20 is a thin, narrow strip of material having a length approximately equal to the total of the diameters of the number of cans to be carried on one side and the hook means are formed by individual clip members 24 or 26 as shown specifically in FIGS. 2 and 3. The clip member 24 includes a pair of legs 28,28 joined by a web section 30 to define a narrow U-shaped central area 32 into which the strip can be forced for frictional engagement with the clip member to thereby secure the clip member to the strip. If desired the legs and/or the strip could be provided with appropriate detent means (not shown) to enhance the grip of the clip member on the strip.

Each clip member 24 also includes a pair of oppositely directed hook portions 34 each of which includes a first arm portion 36 which extends laterally outwardly and downwardly from the upper edge of an adjacent leg, and a reentrant second arm portion 38 which extends downwardly and inwardly from the outer free end of the first arm portion. Adjacent the fold line between the portions 36 and 38 a slit 39 is provided in the portion 38, extending inwardly a short distance from each edge.

Figure 3:
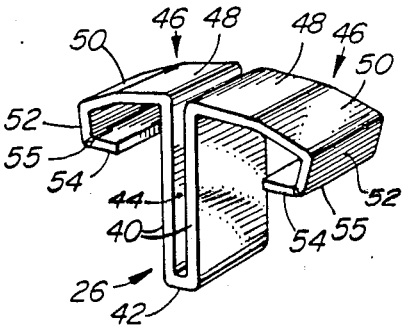
FIG. 3 illustrates a second clip and hook arrangement for use with the first embodiment.

In the embodiment of FIG. 3 the clip member 26 includes legs 40,40 and web section 42 defining the U-shaped area 44 which receives the support member therein, just as with clip member 24. In this case however each hook portion 46 includes a first arm section 48 extending laterally from the upper edge of the adjacent leg 40, a second arm section 50 extending outwardly and downwardly from the first arm section, a third arm section 52 extending downwardly and inwardly from the free edge of the second section, and a fourth reentrant arm section 54 extending laterally inwardly from the lower free edge of the third arm section 52. Again, laterally extending slits, such as 55 could be provided, as between the arm portions 52 and 54 (as shown), in the arm portion 52 itself, or between the arm portions 50 and 52.

Figure 8:
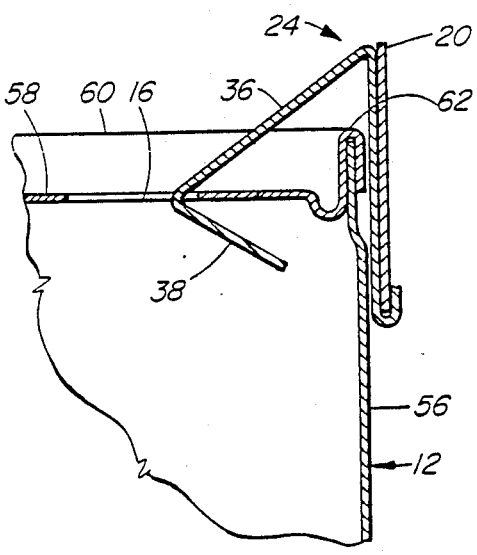
FIG. 8 shows a partial vertical section of the first embodiment, with a can in place, as taken on the line 8—8 of FIG. 1.

The operation of the first embodiment is shown in FIGS. 1 and 8. In FIG. 8 it is seen that a can 12 has a main body defined by side wall 56 and which is turned in at the top. An upper or top plate 58 has the pour opening 16 therein, the top plate being recessed below the top edge 60 defined by an inverted U-shaped flange 62 which is crimped to the top edge of the body 56 around its periphery. It is immaterial whether the opening 16 (or 18) is made by pushing a plug through the opening into the can or by pulling or lifting a tab on top of the can. The present invention will work with all types of cans.

As seen in FIG. 8, when the can is secured to the carrier the arm portion 36 of the hook portion extends over the rim 60 into the opening 16 and the reentrant arm portion 38 engages with the edge of the opening and/or the undersurface of the plate 58 to support the can vertically relative to the support member 20. Also since the arm portions 36,38 are relatively close to the support member 20 it will be evident that once engagement with the can has been achieved it will be more difficult to remove the can than it was to attach the can to the hook means. Attachment is easily achieved by first of all aligning the can more or less with the arm 36 so that the arms 36 and 38 can enter the opening 16 and, when that has been accomplished, the can is rotated downwardly to an essentially vertical orientation.

In the event that the pour opening in the can is narrower than the arm portions of the hook means, the material of the plate 58 can engage with the slits 39, as by rotating the can once the arm portion 38 has been inserted into the opening parallel to the long axis thereof. In this instance the can is supported more by the slits than by the reentrant arm portion.

Figure 4:
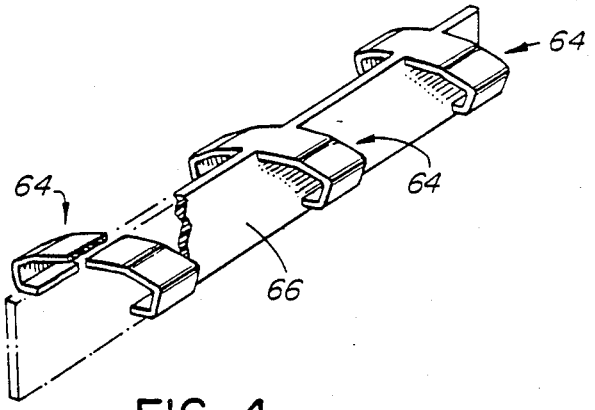
FIGS. 4 to 6 illustrate in perspective view additional embodiments of the can carrier of this invention.
Figure 5:
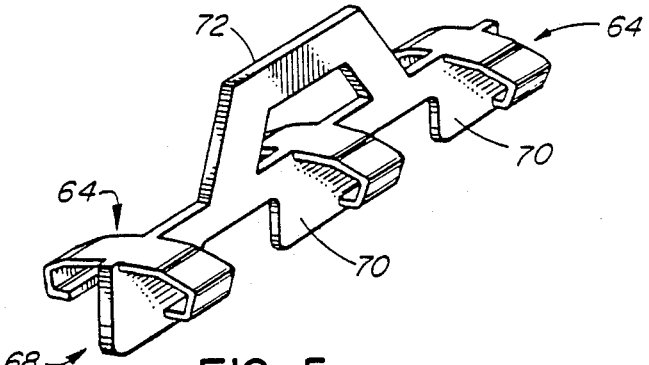

FIGS. 4 and 5 show embodiments of the invention which use hook means similar to those shown in FIG. 3, but which are integrally formed with the support member. Thus, in FIG. 4 the hook means 64 are integrally formed with the support member 66 either through a moulding or casting process in the case of plastic or aluminum material or through an extrusion process for either plastic or aluminum material. In the case of an extrusion process it would be necessary to remove mechanically the material separating the spaced apart hook means so as to properly define such hook means.

In FIG. 5 the support member 68 includes individual longer flaps 70 in the vicinity of the hook means 64 and an integrally formed carrying handle 72 is provided. This embodiment is particularly suited to a moulding process.

Figure 9:
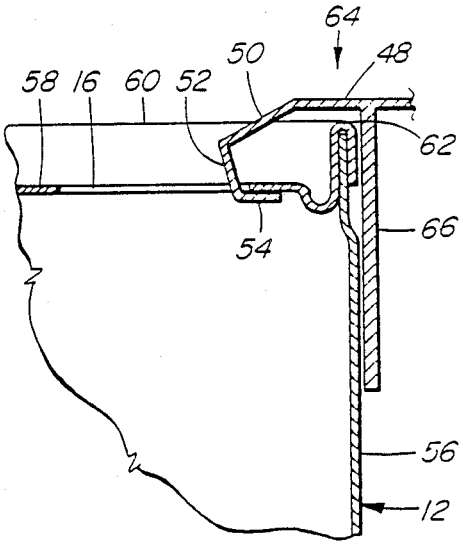
FIGS. 9 and 10 are views similar to FIG. 8 but relating to the embodiments shown in FIGS. 4, 5 and 6.

FIG. 9 illustrates the manner in which a can 12 is held by a hook means 64 of the embodiments of FIG. 4 and 5 and also by the embodiment of FIG. 3. Having regard to reference numbers developed for FIG. 3 it is seen that the first arm section 48 crosses the upper rim 60 of the can and that the second and third arm sections 50,52 extend downwardly and then inwardly of the can via the pour opening 16. The fourth reentrant arm section 54 within the can extends towards the support member 66 and supports the can through supporting engagement with the undersurface of the top plate 58. The can is attached to the carrier in the same manner as aforesaid. Again, the can could be supported by slits 55 if the pour opening is narrower than the hook portion 46, as with the first embodiment.

Figure 6:
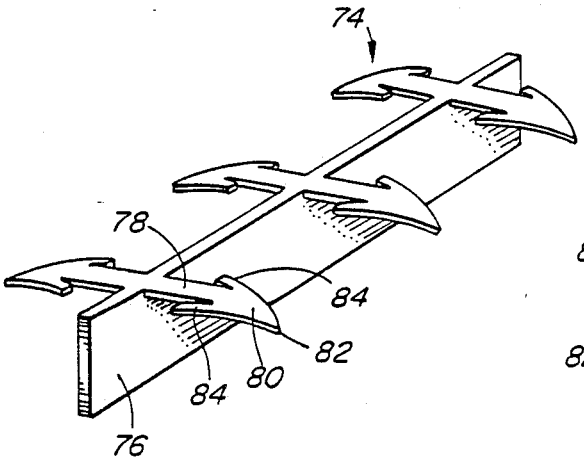
Figure 7:
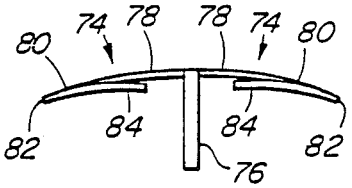
FIG. 7 illustrates an end view of the embodiment shown in FIG. 6.

FIGS. 6 and 7 show a very different hook means for securing a can to a carrier. In this embodiment the hook means 74 are generally arrow-shaped and are integrally formed with the support member 76, although they could be part of a clip member as described in FIGS. 2 and 3. Each hook means 74 includes a first arm section 78 which extends laterally outwardly from the support member 76 and also curves downwardly therefrom. A second arm section 80 continues on from the first section and terminates at a point 82. A pair of tangs 84 is formed adjacent the first section 78, which tangs project slightly downwardly relative to the first section. The continuous outer edges of the tangs and the second arm section converge towards the point 82.

Figure 10:
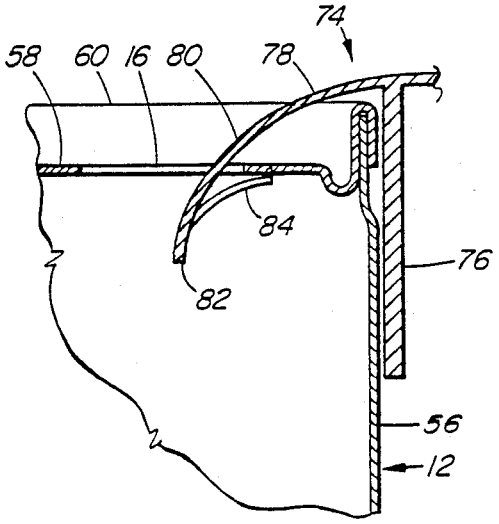

As seen in FIG. 10 a can is attached to the can carrier of this embodiment by pushing the can onto the hook 74 so that the tangs enter the can through the pour opening 16 (or 18). The width of the hook at the tangs is slightly greater than that of the pour opening but there is sufficient resilience in the tangs to permit them to flex slightly as the can is moved onto the hook 74. Once the can is in position it is rotated to the position shown in FIG. 10 whereby the tangs 84 engage with the underside of the plate 58 to support the can thereon.

Figure 11:
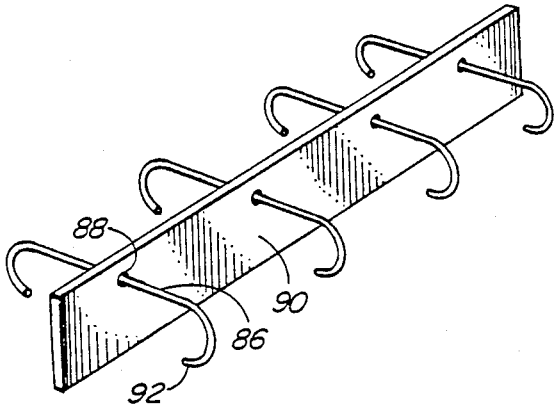
FIGS. 11 and 12 illustrate yet another embodiment of this invention.
Figure 12:
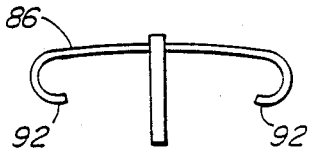

FIGS. 11 and 12 illustrate yet another embodiment wherein the hook means are in the form of C-shaped wires 86 which extend through holes 88 in the support member 90. Each wire 86 includes a reentrant arm portion 92 on each side to support a can through engagement with the underside of the top plate, via the pour opening thereof.

Figure 13:
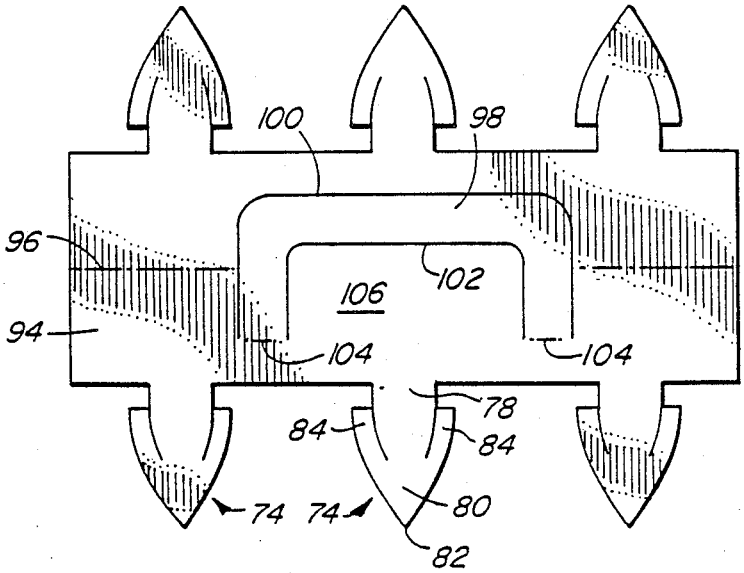
FIG. 13 shows a cardboard blank for still another embodiment of this invention.
Figure 14:
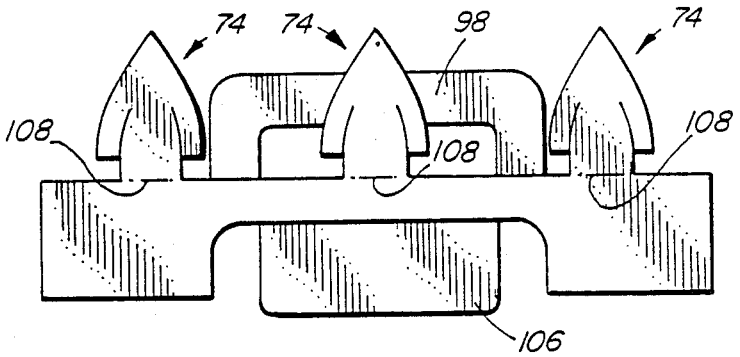
FIG. 14 shows the embodiment of the can carrier formed from the blank of FIG. 13.

FIGS. 13 and 14 show two different views of a can carrier using the principles of FIG. 6, which can be economically manufactured from cardboard, coated if necessary to make it waterproof. The carrier could be manufactured in accordance with standard techniques, the initial result being the flat blank shown in FIG. 13.

FIG. 13 illustrates a rectangular support member 94 which has a central, longitudinally extending fold line 96 formed therein. A plurality of the arrowhead-like hook means 74 as described in FIG. 6 extend laterally outwardly from the member 94. Although six such hook means are illustrated it is understood that any number thereof could be provided.

In the central area of the member 94 a handle 98 is die cut along the lines 100,102 and a fold line 104 is established at the base of each leg of the handle. Between the legs of the handle a flap 106 is formed.

FIG. 14 shows the completed carrier as it might be packaged in a case of full beverage cans. As the final steps of manufacturing the handle is folded upwardly on the lines 104 (towards the viewer in FIG. 13) away from the support member 94 and so that it overlies the upper hook means 74 of FIG. 13. The lower half of the support member 94 is rotated on the fold line 96 so that it in turn overlies the upper half and the lower portion of the handle legs. The two halves of the member 94 are secured together in any acceptable fashion, as by adhesive bonding. The flap 106 does not move and it depends from the support member as seen in FIG. 14, ready to accept advertising or instructional material.

During the bonding step the hook means 74 remain untouched and in the first position of FIG. 14 the lower hook means of FIG. 13 overlie the upper hook means of FIG. 13. When it becomes time to use the can carrier of this embodiment the hook means are folded outwardly about the fold lines 108 to take up a position similar to that shown in FIG. 6 so that the hook means can accept cans as illustrated in FIG. 10. With the hook means folded down the handle is clear for grasping so that a loaded can carrier can be easily taken to a can redemption center.

As indicated previously the can carrier of this invention can be produced from many different materials, or a combination thereof, including plastics, metals (e.g. aluminum), or even stiff paper or cardboard. If it is made of aluminum then it could be recycled along with the cans attached thereto thereby avoiding any requirement to remove cans therefrom. The flat expanse of the support member, as used in any embodiment, is suited to carry advertising if desired. In fact, suitably emblazoned can carriers could be included in cases of canned beverages by the "bottlers" themselves as a disposable, inexpensive, advertising device. Can carriers could also be supplied free of charge, or for a small fee (perhaps refundable), by supermarkets selling the beverages or by the people to whom cans are returned for a refund.

Finally, it should be borne in mind that the foregoing has described but a few embodiments of the present invention, it being contemplated that modifications to the invention or other embodiments thereof could occur to a skilled person in the art. For example, any of the support members illustrated herein, not just those of FIGS. 5, 13 and 14 could be provided with suitable handle means. Also the arm portions 36,38 of FIG. 2 need not be straight, as shown; they could be arcuate, similar to the arcuate wire hook means shown in FIGS. 11 and 12. Similarly, the wire hook means could include straighter sections, rather than being continuous curved and, furthermore, the clip members 24,26 of FIGS. 2,3 could be formed quite simply from wire, in which case the diameter of the hook portions or members would be considerably smaller than the diameter or width of a can pour opening. In considering the present invention, therefore, reference should be made to the claims appended hereto to determine the scope of protection to be afforded the present invention.

THE EMBODIMENTS OF THE INVENTION IN WHICH AN EXCLUSIVE PROPERTY OR PRIVILEGE IS CLAIMED ARE DEFINED AS FOLLOWS:

1. A device for supporting empty beverage cans having a top plate with a pour opening in said top plate, said device comprising: (a) a support portion formed from a blank of material having a longitudinal fold line therein and a handle portion cut from said blank, said blank being folded on itself along said fold line with said handle portion extending upwardly between the adjacent sides of the folded blank; and (b) a plurality of longitudinally spaced apart hook means extending outwardly from the longitudinal edges of said blank, the hook means of one side of the blank overlying the hook means of the other side of the blank in the folded condition thereof, each said hook means including a first section attached to said support portion along a fold line, a second section continuing on from said first section, a tang adjacent each side of said first section, a slit separating each tang from said first section, said tangs being rearward extensions of said second section with edges of said tangs and said second section converging continuously to a point at a free end of said second section; whereby said hook means can be folded about the fold lines connecting said hook means to said support portion and then inserted into the pour opening of an empty can so that the tangs thereof will engage the top plate of the can to support the can adjacent said support portion.

* * * * *